US006374896B1

(12) United States Patent
Møller

(10) Patent No.: US 6,374,896 B1
(45) Date of Patent: Apr. 23, 2002

(54) PIECE OF CLOTH FOR DECORATING A ROLLER BLIND, A KIT OF SUCH PIECES AND A ROLLER BLIND

(75) Inventor: Brent Møller, Gentofte (DK)

(73) Assignee: VKR Holding A/S, Soborg (DK)

( * ) Notice: Subject to any disclaimer, the term of this patent is extended or adjusted under 35 U.S.C. 154(b) by 560 days.

(21) Appl. No.: 09/077,362

(22) PCT Filed: Dec. 16, 1996

(86) PCT No.: PCT/DK96/00530

§ 371 Date: May 28, 1998

§ 102(e) Date: May 28, 1998

(87) PCT Pub. No.: WO97/24505

PCT Pub. Date: Jul. 10, 1997

(51) Int. Cl.[7] ..... E06B 9/08
(52) U.S. Cl. ..... 160/121.1; 160/238
(58) Field of Search ..... 160/121.1, 120, 160/122, 237, 238, 241

(56) References Cited

U.S. PATENT DOCUMENTS

| | | | | |
|---|---|---|---|---|
| 2,024,090 A | * | 12/1935 | Cadmus | 160/237 |
| 2,234,058 A | * | 3/1941 | Murray | 160/237 |
| 2,283,329 A | * | 5/1942 | Johnson | 160/238 |
| 3,186,474 A | | 6/1965 | Levitas | |
| 3,205,118 A | | 9/1965 | Guffan | |
| 4,078,492 A | * | 3/1978 | Levy et al. | 160/238 X |
| 4,907,636 A | | 3/1990 | Simon | |
| 5,203,395 A | | 4/1993 | Koller et al. | |
| 5,400,848 A | | 3/1995 | Gainer | |
| 5,503,210 A | * | 4/1996 | Colson et al. | 160/121.1 X |
| 5,682,939 A | * | 11/1997 | Vargo | 160/121.1 X |

FOREIGN PATENT DOCUMENTS

| | | |
|---|---|---|
| DE | 2124264 | 11/1972 |
| DE | 43 13 660 | 6/1994 |
| DK | 64 631 | 7/1946 |

* cited by examiner

*Primary Examiner*—David M. Purol
(74) *Attorney, Agent, or Firm*—Venable; John P. Shannon; Chad C. Anderson

(57) ABSTRACT

The roller blind is for use in connection with roof windows mounted in pitched roofs and comprises a preferably spring-loaded roller tube (1) which is mountable at the top of the frame or sash structure of the window and a flexible roller blind cloth (2) rolled up thereon as well as an arrangement for retaining the roller blind cloth (2) when rolled out against the spring-load on the roller tube (1) at least in a fully rolled-out condition of the roller blind cloth (2), in which the roller blind cloth (2) in at least a comparatively narrow, ribbon-shaped zone (4) in parallel with the rollertuber (1) is designed for fastening an edge portion of an additional cloth (3) when the roller blind cloth (2) is rolled out, will hang freely down therefrom and when the roller blind is rolled up follow the roller blind cloth (2) during its rolling up on the roller tube (1).

10 Claims, 1 Drawing Sheet

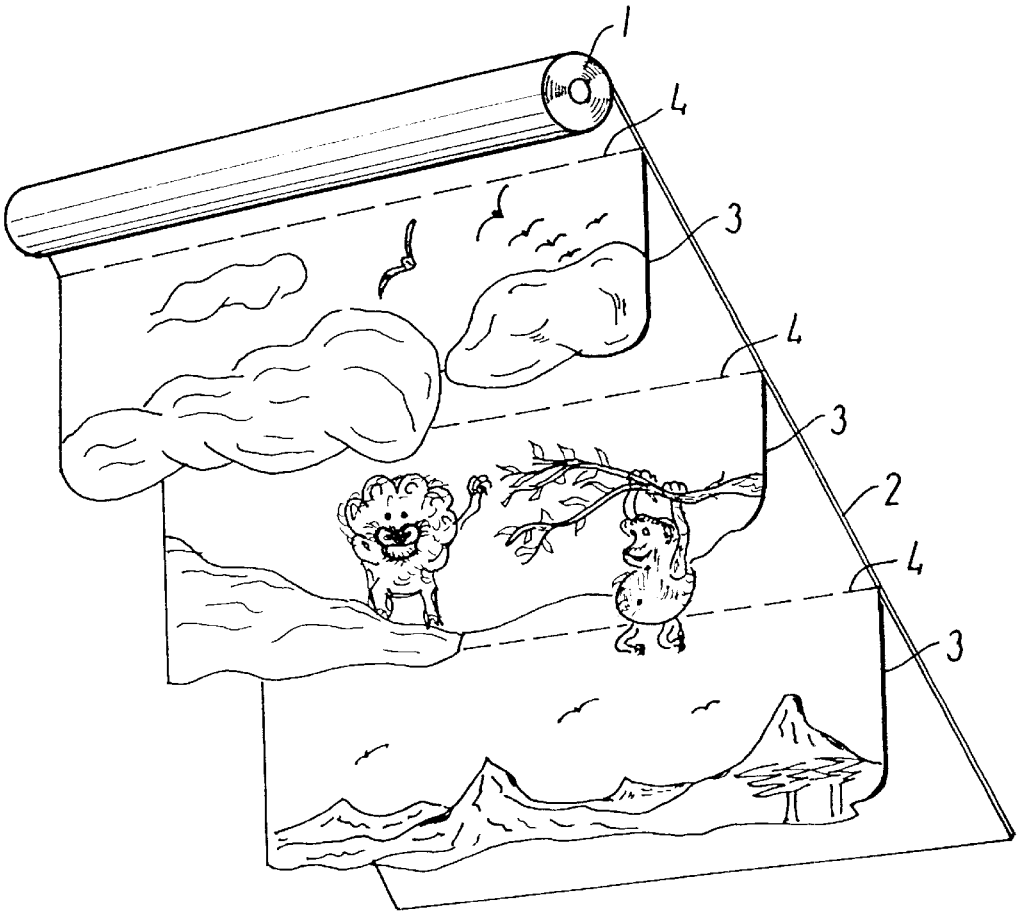
1
4
3
4
3
2
4
3

PIECE OF CLOTH FOR DECORATING A ROLLER BLIND, A KIT OF SUCH PIECES AND A ROLLER BLIND

BACKGROUND OF THE INVENTION

The present invention relates to a piece of cloth of flexible material.

Furthermore, the present invention relates to a roller blind for use in connection with roof windows mounted in pitched roofs, comprising a preferably spring-loaded roller tube which is mountable at the top of the frame or sash structure of the window and a flexible roller blind cloth rolled up thereon as well as means for retaining the roller blind cloth when rolled out against the spring-load on the roller tube at least in a fully rolled out condition of the cloth. Such a roller blind is a common thing for many people in their everyday life.

It is known to provide such roller blinds with pictures, patterns and/or colours to give them an attractive appearance in rolled out or rolled down condition.

Thus a polyester strip having adhesive on both sides for use in connection with adhesion of decorative material on a roller blind is known from U.S. Pat. No. 4,907,636.

Furthermore, U.S. Pat. No. 5,400,848 discloses a translucent, but not transparent roller blind formed from a cloth on which a number of decorative figures has been glued/mounted, said figures partially overlapping, whereby a blind surface of varying layer thickness and subsequently translucency is obtained, as the decorative figures are also translucent.

U.S. Pat. No. 3,205,118 discloses a roller blind in which the cloth comprises two transparent sheets which are adhered to each other along their edges to form an envelope adapted to receive an ornamental sheet to provide a decorated blind.

U.S. Pat. No. 203,395 discloses an adjustable width window shade having a gathered ruffle at the bottom portion thereof. The ruffle is detachable at one end in view of the adjustment. It will not be able to roll up along with the shade on account of its thickness.

DK-C-64631 discloses a roller blind with transmitting openings, which blind hangs down vertically. A piece of a laterally displaceable cloth with corresponding light transmitting openings is suspended on the roller blind with the purpose, by its lateral displacement, of opening or closing the light transmitting openings of the roller blind. The laterally displaceable piece of cloth is not decorated and serves no decorative purpose.

SUMMARY OF THE INVENTION

The object of the present invention is to provide further possibilities for decorating a roller blind.

The object of the invention is met according to a first aspect in that a roller blind is provided with at least one additional cloth of flexible material fastened in a zone in parallel with the roller tube in such a way that, when the roller blind cloth is rolled out, the additional cloth will hang freely down therefrom and when the roller blind cloth is rolled up, it will follow the roller blind cloth during its rolling up on the roller tube.

The object according to a second aspect of the invention is achieved by means of a piece of cloth of flexible material which is characterized in being decorated and having a top edge portion which is horizontal relative to the decoration and which is adapted to be fastened to the cloth of a roller blind such that, when the roller blind cloth is unrolled, the piece of cloth will hang freely down therefrom and, when the roller blind is rolled up, the piece of cloth will follow the roller blind cloth during its rolling up on its roller tube. The upper edge portion is preferably provided with fastening means such as, for instance, an adhesive, a zipper, Velcro tape, snap fasteners or the like.

Preferably, several such pieces of cloth constitute a kit.

The object is met according to a third aspect of the invention is met by means of a roller blind characterized in that the cloth, in at least a comparatively narrow, ribbon-shaped in zone parallel with the roller tube, is designed for fastening an edge portion of an additional cloth of flexible material, such that, when the roller blind cloth is rolled out, the additional cloth will hang freely down therefrom and when the roller blind is rolled up, the additional cloth will follow the roller blind cloth during its rolling up on the roller tube. In this way an additional cloth with a decorative appearance can be mounted on the cloth of the roller blind, whereby an additional decorative effect is obtained.

The roller blind cloth and the additional cloth may in said zone or edge portion, respectively, be provided with means for detachable fastening of the additional cloth, which means may comprise a zip, snap fasteners, Velcro tape, adhesive tapes or the like. In this way the additional cloth and, consequently, its decorative effect may be changed.

The difference between the three aspects is that, according to the second aspect, decorative pieces of cloth are provided which may be mounted on a roller blind, whereas, according to the third aspect, a rollerblind is prepared for the fastening of such an additional decorative piece of cloth, which according to the first aspect is fastened.

The roller blind cloth is preferably provided with several of said zones which are preferably positioned such that the one cloth is or the additional cloths one, when the roller blind cloth is rolled out, fastened thereto at substantially equally spaced distances within an area which, from the roller tube, extends downwards approximately ⅔ of the fully rolled out length of the roller blind cloth. In this way, the opportunity is provided for mounting several additional pieces of cloth, whereby a spatial effect is obtainable which corresponds to the one known from theatre coulisses. The effect may be further enhanced by suitable decoration of the cloth of the roller blind itself.

When the cloth of the roller blind according to the second aspect of the invention is designed for the fastening of a further cloth, it is to be understood that there are position indications in the form of markings for the positioning of the edge area of the additional cloth when it is to be fastened, for instance by gluing, or the roller blind cloth is provided with said means for detachable fastening of the additional cloth.

The reason why the additional cloth is to be fastened in a zone in parallel with the roller tube is that an additional cloth fastened in an oblique zone would cause problems during rolling up, because the obliquely fastened cloth would be prone to cause a skewed rolling up of the roller blind cloth on the roller tube. It is, however, to be understood that a small deviation of the zone from strictly parallel will not impede the rolling up of the roller blind and, therefore, falls within the scope of the invention.

In respect of the number of additional cloths and their fastening means, the number is only limited by the consideration that, at a given use, there may be limited room for the roller tube with a fully rolled-up roller blind.

It is to be understood that the additional cloth may extend over a bigger or smaller width of the roller blind, provided that it is or they are, if several are placed in a row, be placed symmetrically relative to the centre of the roller blind, as problems may otherwise arise in form of a skewed rolling up.

It should further be understood that the additional cloth may be slit, for instance in form of frills.

BRIEF DESCRIPTION OF THE DRAWINGS

The invention will now be explained in detail by means of an example of an embodiment with reference to the drawing, the sole FIGURE of which schematically shows a perspective view of a rolled down roller blind in an imaginary window.

DETAILED DESCRIPTION OF THE DRAWINGS

The FIGURE shows a roller blind known per se with a roller tube 1 and a roller blind cloth fastened thereon, said roller blind cloth being rolled out in this case. The roller tube 1 may be spring-loaded in order to roll up the roller blind cloth 2, or a cord control (not shown) of known type may be provided for rolling up and/or rolling down the roller blind cloth 2.

On the roller blind cloth three additional pieces of cloth 3 are fastened, said pieces being fastened to the roller blind cloth 2 in narrow lanes 4 in parallel with the roller tube 1. The additional cloths 3 have different shapes, impressions, and/or painting, thus providing together a three-dimensional picture when hanging down from the roller blind cloth 2.

The cloths 3 are of a flexible material such that they may follow the roller blind cloth 2 during its rolling up on the roller tube 1. The cloths may be permanently or detachably fastened in any suitable way.

What is claimed is:

1. A roller blind for use in connection with a roof window mounted in a pitched roof, the window having a frame having a top, comprising:

a roller tube (1) which is mountable at the top of the frame of the window;

a flexible roller blind cloth (2), said roller blind cloth having a rolled up condition in which the roller blind cloth is rolled up on the roller tube and a rolled out condition in which part of the roller blind cloth is rolled off the roller tube, the roller tube being resiliently biased toward rolling said roller blind cloth to its rolled up condition; and means for retaining the roller blind cloth (2) in the rolled out condition against the resilient bias of the roller tube (1), wherein at least one additional flat cloth (3) of flexible material is fastened on the roller blind cloth in a zone (4) in parallel with the roller tube (1), the additional flat cloth (3) hanging freely from the roller blind cloth (2) when the roller blind cloth is in its rolled out condition, and the additional flat cloth being rolled up on the roller tube together with the roller blind cloth when the roller blind cloth is in its rolled up condition.

2. A roller blind according to claim 1, characterized in that the roller blind cloth (2) is provided with several of said zones (4).

3. A roller blind according to claim 2, characterized in that the roller blind has a plurality of said additional flat cloths, and said zones (4) are positioned so that the additional flat cloths (3), when the roller blind cloth (2) is rolled out, are fastened to the roller blind cloth at substantially equally spaced distances from one another within an area which, from the roller tube (1), extends downwards approximately ⅔ of the fully rolled out length of the roller blind cloth (2).

4. A roller blind according to claim 1, wherein said additional flat cloth is decorated and has a top edge portion which is horizontal relative to the decoration.

5. A roller blind according to claim 4, wherein said top edge portion is provided with means for fastening said additional flat cloth to said roller blind cloth.

6. A roller blind according to claim 1 for, wherein the roller tube (1) is mountable at the top of the frame of the window and the roller blind cloth (2) defines a plurality of ribbon-shaped zones (4), the ribbon-shaped zones being in parallel with the roller tube (1) and being adapted to be fastened to an edge portion of the additional flat cloth (3) of flexible material, such that, when the roller blind cloth (2) is rolled out, the additional cloth (3) will hang freely down therefrom and, when the blind is rolled up, the additional cloth (3) will follow the roller blind cloth (2) during its rolling up on the roller tube (1).

7. A roller blind according to claim 6, characterized in that the ribbon-shaped zones of the roller blind cloth (2) and the edge portion of the additional flat cloth (3) have means for detachably fastening the additional flat cloth.

8. A roller blind according to claim 5, wherein the roller blind is devoid of means for fastening said additional flat cloth to said roller blind cloth outside said top edge portion.

9. A kit for decorating a roller blind for use in connection with a roof window mounted in a pitched roof, wherein the window has a frame having a top, and the roller blind includes a roller tube (1) which is mountable at the top of the frame of the window; a flexible roller blind cloth (2), said roller blind cloth having a rolled up condition in which the roller blind cloth is rolled up on the roller tube and a rolled out condition in which part of the roller blind cloth is rolled off the roller tube, the roller tube being resiliently biased toward rolling said roller blind cloth to its rolled up condition; and means for retaining the roller blind cloth (2) in the rolled out condition against the resilient bias of the roller tube (1), comprising:

a plurality of flat additional cloths (3) of flexible material each adapted to be fastened on the roller blind cloth in a zone (4) in parallel with the roller tube (1) in such a way that the additional cloths (3) hang freely from the roller blind cloth (2) when the roller blind cloth is in its rolled out condition and are rolled up on the roller tube together with the roller blind cloth when the roller blind cloth is in its rolled up condition, each said flat additional cloth having means for detachably fastening said flat additional cloth to said zone.

10. A kit according to claim 9, wherein the flat additional cloths, when spaced from one another on the roller blind cloth, cooperate with one another to define a 3-dimensional image.

* * * * *

UNITED STATES PATENT AND TRADEMARK OFFICE

CERTIFICATE OF CORRECTION

PATENT NO. : 6,374,896 B1
DATED : April 23, 2002
INVENTOR(S) : Brent Moller

It is certified that error appears in the above-identified patent and that said Letters Patent is hereby corrected as shown below:

Title page,
Item [56], Foreign Application Priority Data, add
-- December 29, 1995 (DK)..... 1484/95 --

Signed and Sealed this

Third Day of December, 2002

JAMES E. ROGAN
*Director of the United States Patent and Trademark Office*